United States Patent [19]

Shen

[11] Patent Number: 4,688,331

[45] Date of Patent: Aug. 25, 1987

[54] ELLIPSOGRAPH

[76] Inventor: Xingdi Shen, 102 Bld. 5, Beiwalu 3, Beijing, China

[21] Appl. No.: 886,019

[22] Filed: Jul. 16, 1986

[30] Foreign Application Priority Data

Jul. 16, 1985 [CN] China ..... 85105426

[51] Int. Cl.[4] ..... B43L 11/04

[52] U.S. Cl. ..... 33/30.1; 33/30.7

[58] Field of Search ..... 33/30.1, 30.4, 30.6, 33/30.7

[56] References Cited

U.S. PATENT DOCUMENTS 2,926,423 3/1960 Johnson ..... 33/30.7

3,854,213 12/1974 Armitt ..... 33/30.7

FOREIGN PATENT DOCUMENTS 948817 9/1956 Fed. Rep. of Germany ..... 33/30.1

259313 6/1928 Italy ..... 33/30.1

*Primary Examiner*—Richard R. Stearns

*Attorney, Agent, or Firm*—Michael N. Meller

[57] ABSTRACT

The crank guide rod mechanism for performing nearly rectilinear motion is formed by using the mathematical method from which is designed the ellipsograph of the hidden cross-groove principle employing two points of support for the suspension-extension support frame. This will enable the drawing pen to move on the face of the paper in a suspended manner. The steering rod is made up of two long slabs (the rule and the steering rod) within the plane of projection, which enables the handle on the top to drive the drawing pen and describe the whole ellipse directly.

11 Claims, 5 Drawing Figures

ELLIPSOGRAPH

FIELD OF THE INVENTION

This invention relates to an ellipsograph, which is an instrument often used in mathematical, physical, mechanical and architectural drawings.

BACKGROUND OF THE INVENTION

Ever since the first patent for this type of instrument was issued to an American, Mr. Hayen (U.S. Pat. No. 3,947,968) in 1874, special publications of this nature have appeared time and again, and a search of international Patent Gazettes issued during the last decade or so reveals that available ellipsograph designs fall into five categories:

(1) The string type utilises the principle that the sum of the distances of any point on the ellipse to two focal points is constant.

(2) The projection image copying type is designed on the principle that all kinds of ellipses can generally be drawn on paper along the edge of the shadow mimicked by a circular board model inclined at various degrees in space. This category may be typified by U.S. Pat. No. 4,194,292.

(3) The obliquely cut cylinder type is prepared by ensleeving another leg on one of the legs of the dividers, enabling it to rotate and slide up and down with the drawing pen, forming an adjustable included angle to it. This is typified by U.S. Pat. No. 4,204,327. Ellipsographs designed according to the above three principles cannot describe ellipses that are very small, nor those that are fairly elongated.

(4) The planetary gear type is typified by the ellipsograph disclosed in U.S. Pat. No. 4,226,022. It can hardly overcome the crawling which causes lines drawn in this way to have a saw-tooth appearance.

(5) The cross groove type includes the majority of ellipsographs designed like those disclosed in DT2743352, SU454139, and BG1754588. This type has the advantage of being able to draw elongated ellipses while its defects include the following: it is difficult to ensure the matching precision of the slide groove and the coincidence of the elliptical line drawn in opposite directions; its grooved frame tends to be clumsy; it requires that the unevenness of the paper surface

SUMMARY OF THE INVENTION

The present invention makes use of the unique mathematical principle to find the hidden cross-groove mechanism, thereby realizing precision in the drawings made and completeness in the range of drawing. The ellipsograph of the invention is capable of describing various ellipses including one whose major and minor axes are equal (a circle), one whose two axes are not equal (an ordinary ellipse), and one whose minor axis is zero (a straight line). It is not only possible to draw large ellipses with the invention, but extremely small ones ellipses (1–2 mm) may also be described readily. Besides, its structure is simple its operation is convenient. The ellipsograph of the invention will fully satisfy the requirements for all kinds of engineering drawings.

The structure of this invention includes a crank guide rod mechanism, a longitudinal guide mechanism, a rotary drawing mechanism, and a supporting frame.

BRIEF DESCRIPTION OF THE DRAWINGS

Of the accompanying drawings.

DETAILED DESCRIPTION OF THE PREFERRED EMBODIMENT

Figure 1:
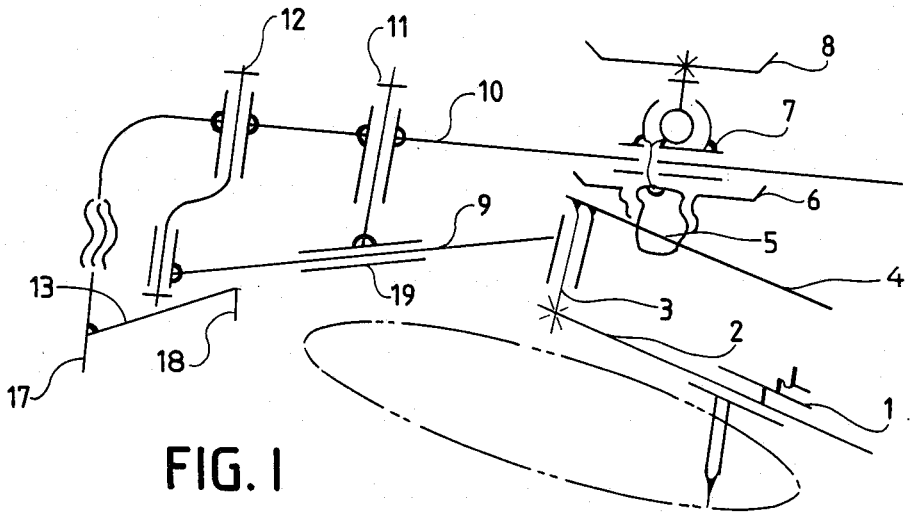
FIG. 1 is a block diagram of the invention.

The crank guide rod mechanism, in which the guide-rod head can perform an almost rectilinear motion, comprises the crank 12, pendulum shaft 11, and guide rod 9. At the lower part of the pendulum shaft 11, the rotable guide groove 19 with an opening is used to control the sliding of the guide rod to permit it to skip up and down without getting stuck. This calls for the use of the mathematical method to find out the ratio for the radius of the crank, the center distance between the crank and the pendulum shaft as well as the length of the guide rod 9, and to set the ratio of the three to a specific value. For example, the guide-rod head will pendulate in a manner nearly approaching rectilinear motion when such a ratio is taken as 1:1.8:7.84, in which case the main axis 3 at the end of the guide rod 9 will move rectilinearly with a precision of approximately 1000:1 straightness (to be proved below). This motion pair replaces the lateral groove of the cross-groove principle, and provides the basis for designing the simplified structure of this invention which eliminates the clumsiness of the cross and upgrades the precision.

The longitudinal guiding mechanism is made up of the main frame 10 and the guide sleeve 7, which is equivalent to the longitudinal groove of the cross groove and is located at the front part of the frame 10. Their cross sections are respectively semi-circular cut tube and the semicircular fanning, both of which form a slightly elastic fold. This not only eliminates the clearance and rotation between them but also facilitates sliding. As a result, precision and flexibility are upgraded.

Figure 5:
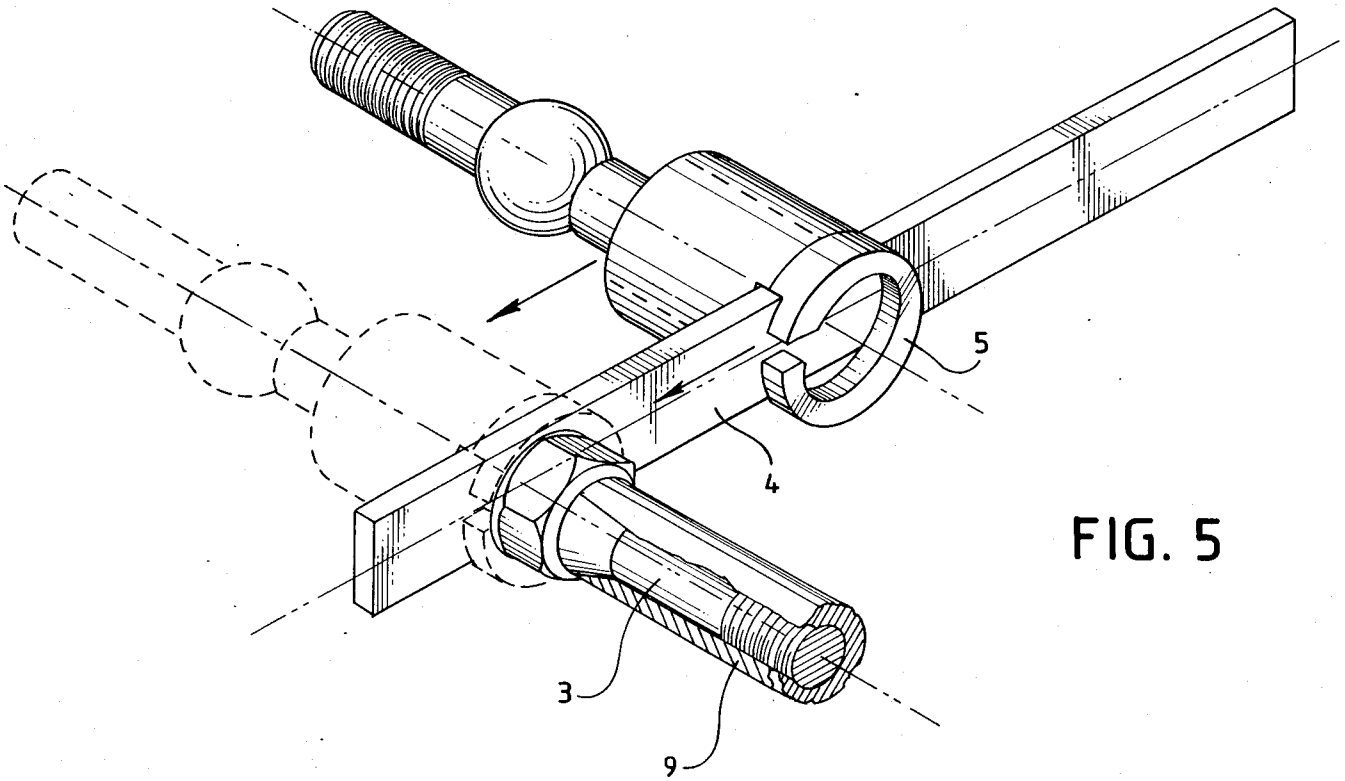
FIG. 5 shows details of the rule. In the attached drawings, 1 indicates the pen holder, 2—the drawing rod, 3—the main axis, 4—the rule, 5—the upper axis, 6—the hand nut, 7—the guide sleeve, 8—the handle, 9—the guide rod, 10—the main frame, 11—the pendulum shaft, 12—the crank, 13—the leg, 14—the adjustable screw means, 15—screw rod, 16—sleeve, 17—needle, 18—needle, and 19—guide groove.

The rotary drawing mechanism is made up of the handle 8, upper axis 5, hand nut 6, rule 4, main axis 3, drawing rod 2 and pen holder 1. On the lower part of the upper axis 5 there are threads that mesh with those of the hand nut 6 and the square hole that slide-matches with the rule 4. At the lower end of the upper axis 5, there is a hole which is matched loosely and turnably with the upper end of the main axis 3. This hole has a groove with a side opening which enables the upper axis 5 to slide at any place on the rule 4 and reach a position forming a straight line with the main axis 3 for drawing purposes (FIG. 5), then use is made of the hand nut 6 to lock and fix the upper axis 5 at any random place on the rule 4 which bears the scale graduations to determine the minor axis. The middle part of the upper axis 5 is ball-shaped and is enfolded on the guide sleeve 7 to form a loosely rotating match capable of automatic centering with the lower main axis, and then extended from one side of the main frame to be fixed with the handle above. The handle is able to do a 360° rotation of the drawing mechanism while driving the upper axis 5 to move longitudinally along the front part of the main frame. The main axis 3 also fixes the rule 4 and the drawing rod 2 within the plane of the plumb. They combine to form the steering rod equivalent to that of the cross-groove principle. Therefore, by shifting the pen holder 1 on the drawing rod and altering the locking point of the upper axis 5 on the rule 4, the major and minor axes of the ellipse may easily be determined. Then the ellipse can be drawn simply by turning the handle 8. The cross section of the drawing rod 2 is a right-angled trapezium on the slope of which are graduations for determining the major axis. On its right-angled side is the positioning groove, while on the pen holder 1 are the corresponding right-angled trapezoidal groove and the positioning screw pin for enabling the stylus to be shifted and positioned within the same plumb plane through the grooved plate center. There are graduations on the rule 4 for determining the minor axis. There is provided adjustable screw means 14 at one end of the drawing rod 2 for finely adjusting of for precise centering.

The supporting frame comprises the leg 13 with a screw rod 15 linking the leg 13 to the main frame 10 by way of sleeve 16. The leg 13 may be turned to a position forming a right angle with the supporting frame and "pinned dead" on it for the purpose of making the drawing. Besides, the two needles 17, 18 at the ends of the leg are used for two-point positioning. At this moment, the drawing mechanism is in the state of suspension extension. The drawing stylus will move across the paper in a suspended manner to cope with the uneven surface of the paper and the length of the stylus. The leg may also be turned to be in the same plane as the instrument to facilitate packing in a case.

The guide-rod head of the crank guide-rod mechanism in this invention may be designed to have the following ratio: $r:x_o:L=1:1.8:7.84$) as described with regard to the performance of rectilinear motion.

Figure 4:
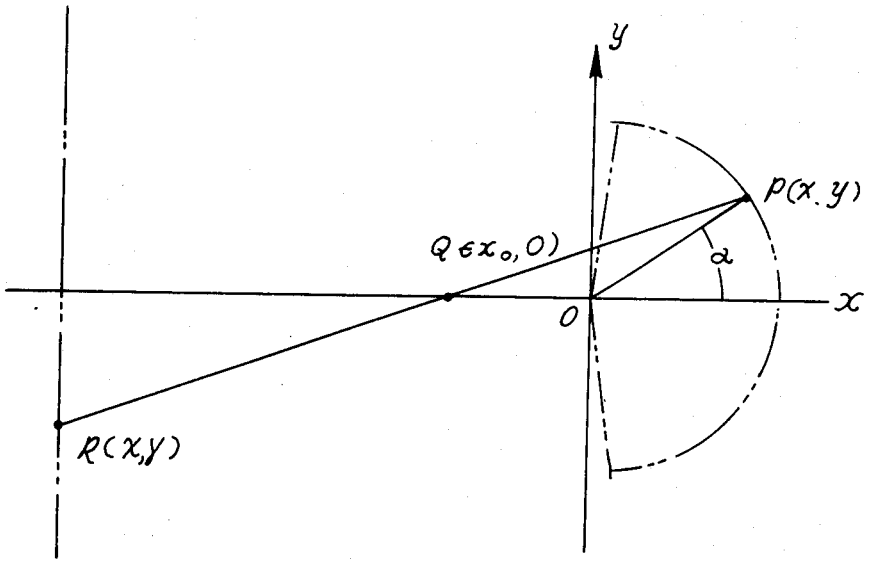
FIG. 4 is the mathematical proof diagram.
Figure 2:
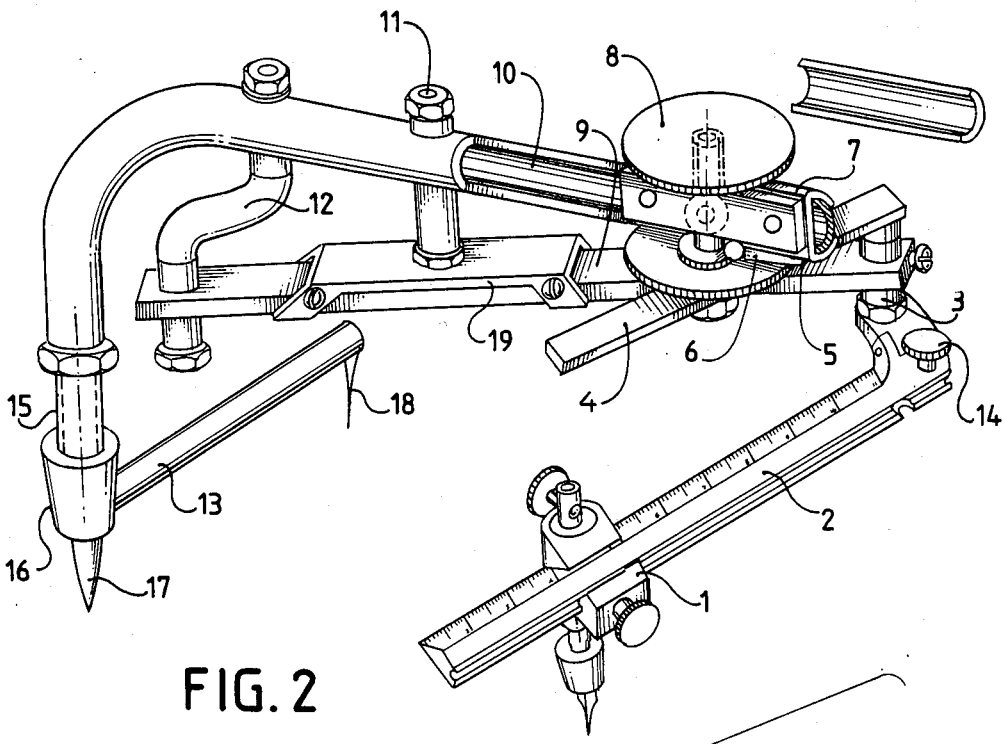
FIG. 2 is a perspective view.
Figure 3:
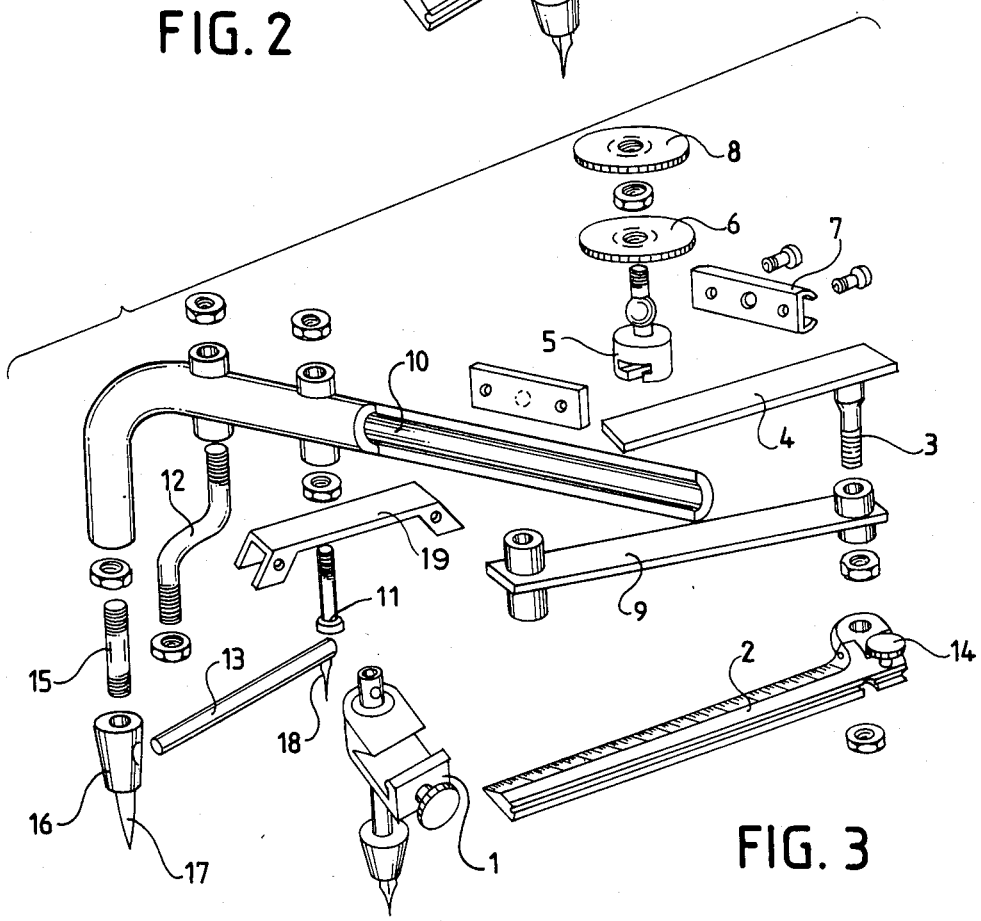
FIG. 3 is an exploded view of the invention.

The main axis 3 is subjected to the restraint of the guide rod 9, the crank 12 and pendulum shaft 11 to produce the specific curve motion. Taking the coordinates as given in FIG. 4 and the center of the crank as the origin O, then OP is the radius of the crank, $(-x_o,0)$ is the centre of the pendulum shaft, RP is the pendulating guide rod, and R(XY) is the center of the main axis. Its orbit equation is:

$$x = r\cos\alpha \tag{1}$$

$$y = r\sin\alpha$$

$$Y - y = \frac{r\sin\alpha}{r\cos\alpha + x_o}, (X - x)$$

$$L^2 = (X - x)^2 + (Y - y)^2$$

where (x,y) are the coordinates of point P, r is the length of OP, $\alpha$ is the included angle of OP and OX, and L is the length of RP.

Solving these equations for X, we have:

$$X = r\cos\alpha - \frac{L(r\cos\alpha - x_o)}{\sqrt{r^2 + 2rx_o\cos\alpha + x_o^2}}$$

For example, when $r:X_o:L=1:1.8:7.84$, the above equation may be simplified as follows:

$$X = r\cos\alpha - \frac{4.13242809\gamma(\cos\alpha + 1.8)}{(\cos\alpha + 1.17)^{\frac{1}{2}}}$$

Based on designing requirements, we may take $\alpha=(-81°40',+81°40')$.

The maximum error of this equation and the rectilinear equation $x=-6.84r$ is very small, and may be found by using the extreme values:

$$\frac{dX}{d\alpha} = -\alpha\sin\alpha\left[1\frac{4.132042809}{(\cos\alpha + 1.17)^{\frac{1}{2}}} + \frac{2.06621404(\cos\alpha + 1.8)}{(\cos\alpha + 1.17)^{3/2}}\right]$$

Take $\frac{dX}{d\alpha} = 0$, $\alpha(-81°\ 40',\ +81°\ 40'')$.

$$\text{We get}\begin{cases}\cos\alpha_1 = 1 \text{ for } & \alpha_1 = 0\\ \cos\alpha_2 = 0.44543 & \alpha_2 = 63°\ 32'57''\end{cases}$$

Therefore, there are two extreme values within this region:

$$\begin{cases}X_1(\alpha_1) = -6.84r\\ X_2(\alpha_2) = -6.83712r\end{cases}$$

The boundary value of this function in the region $(-81°40',+81°40'')$ is $$X_{3,4}(\cos\pm 81°40'') = -6.8428r$$

The maximum deviation of these extreme values and the boundary value from the straight line $X=-6.84r$ is 0.00288r. As this function is continuous in this region, therefore, its rectilinear maximum deviation within the region is also smaller than and equal to 0.00288r.

Since twice the Y value of the two boundary points $(\alpha\pm 81°40'')$ in formula (1) above is the length of the straight line in the region $(-81°40',\ +81°40'')$, we substitute sin $81°40''=0.98944164$ and cos $81°40''=0.14493186$ into equation (1), and get $Y=2.565428r$. Therefore, the length of the straight line section should be $2y=5.1308r$. Its divergence from straightness should be:

$$2\cdot\frac{0.00288r}{5.1308r} = 0.001$$

This error, when compared with other factors like the comparison of the error produced by the clearance of various moving pairs and the other structural states or the changes in the contact points of the stylus on the face of the paper during rotation, is too slight to deserve consideration. Due to factors like its simple structure and others that result in its higher structural precision, the overall precision of this invention is very high. A good number of practices have proved that it can fully satisfy the requirements of engineering drawings by attaining a high level of precision in all applications.

I claim:

1. An ellipsograph having hidden cross-groove means comprising a crank guide rod means (9,11,12) having a guide rod head, a longitudinal guiding means (7,10)

having a guide sleeve (7), a rotary drawing means (1–6,8) and a supporting means (13,16–18), said rotary drawing means being coupled to said guide rod head and said guide sleeve, said crank guide rod means and said supporting means being pivotably coupled to said longitudinal guiding means, wherein said crank guide rod means are capable of moving such that said guide rod head performs a first substantially rectilinear motion, and said longitudinal guiding means are capable of moving such that said guide sleeve performs a second substantially rectilinear motion, said second substantially rectilinear motion being substantially perpendicular to said first substantially rectilinear motion, said first and second substantially rectilinear motions constituting the transverse and longitudinal motions of said hidden cross-groove means respectively.

2. The ellipsograph as defined in claim 1, wherein said longitudinal guiding means comprises a main frame (10) and said guide sleeve (7) slidably mounted thereon, and wherein said crank guide means comprises a guide rod (9), a crank (12) pivotably coupled to said main frame and to said guide rod at one end thereof, said guide rod head being located at the other end of said guide rod and being pivotably coupled to said rotary drawing means, a pendulum shaft (11), pivotably coupled to said main frame, and a guide groove (19) coupled to said pendulum shaft and slidably coupled to guide rod, said crank having a radius of rotation OP, said crank and pendulum shaft having axes which are separated by a distance $X_o$, and said pivotable couplings of said guide rod to said crank and to said rotary drawing means having axes which are separated by a distance RP, said guide rod head being capable of performing substantially rectilinear motion when OP, $X_o$ and RP have a predetermined relationship.

3. The ellipsograph as defined in claim 2, wherein said guide sleeve (7) comprises a fanning having a semi-circular cross section, and said main frame has a first portion comprising a cut tube having a semi-circular cross section, said fanning portion of semi-circular cross section riding along the outer circumferential surface of said first portion of said main frame during sliding of said guide sleeve.

4. The ellipsograph as defined in claim 3, wherein said rotary drawing means comprises a rule (4) and a drawing rod (2) rigidly connected by a first axis means (3), said first axis means being pivotably coupled to said guide rod head, and a pen holding means (1) slidably mounted on said drawing rod, said pen holding means having a screw means for locking said pen holding means at a predetermined position on said drawing rod, said predetermined position on said drawing rod corresponding to the major axis of the ellipse to be drawn.

5. The ellipsograph as defined in claim 4, wherein said rotary drawing means further comprises a second axis means (5) slidably mounted on said rule, a nut means (6) for locking said second axis means at a predetermined position on said rule and handle means (8) coupled to said second axis means for driving said second axis means along said first portion of said main frame, said predetermined position of said second axis means on said rule corresponding to the minor axis of said ellipse to be drawn.

6. The ellipsograph as defined in claim 5, wherein said second axis means has a spherical middle portion which is rotatably coupled to said guide sleeve with a play, whereby said first and second axis means can be automatically center-adjusted during drawing of said ellipse, a lower portion having threads which mesh with threads on said nut means and a hole of rectangular cross section which slide-matches with said rule, and a lower end portion having a bore for receiving said first axis means with play which communicates with said hole and having a recess which communicates with said bore and said hole for allowing passage of said first axis means therethrough when said second axis means is slid along said rule to a position where said first and second axis means are substantially aligned.

7. The ellipsograph as defined in claim 4, wherein said drawing rod is adjustably coupled to said first axis means by an adjustable screw means.

8. The ellipsograph as defined in claim 4, wherein said support means comprises a leg means (13,16), and first and second pointed members (17,18) connected thereto, said leg means being pivotably coupled to said main frame, whereby said leg means and main frame are relatively rotatable between first positions whereat said leg means and said main frame are co-planar and second positions whereat said leg means and said main frame are at right angles.

9. The ellipsograph as defined in claim 8 further comprising a stylus mounted in said pen-holding means, said ellipsograph being supported on a drawing surface during drawing by said first and second pointed members and said stylus.

10. The ellipsograph as defined in claim 5, wherein said rule and said drawing rod having scale graduations formed thereon.

11. The ellipsograph as defined in claim 2, wherein said guide groove is slidably coupled to said guide rod with sufficient play to enable said guide rod to skip up and down without jamming.

* * * * *